US005588738A

United States Patent [19]

Meoli

[11] Patent Number: 5,588,738

[45] Date of Patent: Dec. 31, 1996

[54] LANTERN

[76] Inventor: Rudy B. Meoli, 1660 Orchard Dr., Placentia, Calif. 92670

[21] Appl. No.: 500,050

[22] Filed: Jul. 10, 1995

[51] Int. Cl.[6] ..... F21L 7/00

[52] U.S. Cl. ..... 362/184; 362/260; 362/280; 362/240; 362/241; 362/449

[58] Field of Search ..... 362/260, 802, 362/184, 276, 196, 277, 280, 223, 224, 240, 241, 449; 340/567, 541

[56] References Cited

U.S. PATENT DOCUMENTS

| | | | |
|---|---|---|---|
| 4,663,697 | 5/1987 | Stearns et al. | 362/260 |
| 5,015,994 | 5/1991 | Hoberman et al. | 340/567 |
| 5,293,306 | 3/1994 | Bamber | 362/280 |
| 5,309,145 | 5/1994 | Branch et al. | 362/802 |

*Primary Examiner*—Ira S. Lazarus
*Assistant Examiner*—Sara Sachie Raab
*Attorney, Agent, or Firm*—Georges A. Maxwell

[57] ABSTRACT

A lantern including a battery power supply, a pair of fluorescent tubes, a normally open manually operable multi-position switch, a motion detector device with a normally open switch and an electric-powered horn. The switch operates to selectively connect the power supply with one or both of the tubes or with the motion detector. By operation of the multi-position switch, the motion detector selectively operates to connect the power supply with the pair of tubes, with the pair of tubes and the horn or with the horn when the switch thereof is closed in response to detected motion. The lantern further includes a light reflector selectively moveable from a stored position to an operating position where it reflects and concentrates light emitted by the tubes in a limited field of view adjacent a side of the lantern within which motion is to be detected by the motion detector.

11 Claims, 6 Drawing Sheets

G'
8
27
77
26
25
75
72
74
20
S
M
9
70
72
85
6
8
73
T
86
R
T
R'
90
91
32
33
2
9
F
87
92
32
86
95
32
34
L
33
P
2
30
J'
J
32

LANTERN

BACKGROUND OF THE INVENTION

From time immemorial, man has utilized portable lanterns to light his way in the dark. For many years, the light source for lanterns was light emitted by flames or the combustion of flammable materials. Upon the advent of electric cells or batteries and the advent of incandescent lamps, the light source in many lanterns has been battery-powered incandescent lamps. With the more recent advent of fluorescent tubes, those in the art of manufacturing lanterns have turned to the use of battery-powered fluorescent tubes to generate desired light.

A large percentage of lanterns now being produced are specially made for use by outdoorsmen or campers to light campsites. To that end, lanterns with battery-powered fluorescent tubes have proven to be highly effective and efficient and are fast becoming the most favored form or class of lanterns.

In addition to lighting campsites, at night, and to thereby enable campers to find their way about their campsites, lanterns serve to prevent or discourage wild animals, as well as uninvited humans, from entering and pillaging campsites. While the foregoing is an extremely valuable purpose or end that can be attained by the use of lanterns, it can seldom be utilized since the battery power that is available to energize the lanterns is quite limited and is such that it must be used sparingly. That is, if a lantern is left on (illuminated) throughout the night for the purpose of discouraging potential intruders, the supply of power afforded by the batteries is likely to be completely exhausted well before the night has passed. In such a case, a lantern is rendered useless for its intended purpose, should the generating of light be required. Accordingly, electric camp lanterns are necessarily used frugally to conserve of power and in a manner that light is only generated when it is truly needed.

Another notable shortcoming that exists in camp lanterns with battery-powered fluorescent tubes resides in the fact that the light emitted from such tubes is soft and diffused light and is such that it is often not so bright, sharp and crisp that it will illuminate a limited area with sufficient light to enable persons to comfortably read or do close work. Accordingly, when concentrated light, sufficient to do close work is required, special lanterns equipped with light reflectors that concentrate light generated by the tubes, are provided.

When concentrated light is required and lanterns without light reflectors are all that are available, it is common practice by many persons to jerry-rig reflectors of aluminum foil or the like and position those reflectors adjacent or about the lanterns in efforts to attain desired lighting effects.

Yet another shortcoming to be found in lanterns of the general class here concerned with resides in the fact that when it is required to replace or otherwise service the tubes of the lanterns, the lanterns must be disassembled to a substantial extent. For example, multiplicities of screw fasteners utilized to secure the parts of the lanterns together must be removed to effect disassembly of the lanterns and to gain access to the tubes thereof, for replacement purposes. To effect the replacement of tubes in such lanterns often requires the exercise of considerable skill and, all too frequently, results in the losing and/or damaging of parts.

OBJECTS AND FEATURES OF THE INVENTION

It is an object of the present invention to provide an improved portable battery-powered fluorescent tube lantern that operates to automatically energize the tubes (to emit light) in response to movement of objects of predetermined mass and/or size within a predetermined area adjacent the lantern.

Another object of the invention is to provide a lantern of the general character referred to above that is selectively operable to automatically emit an audible signal in response to movement of an object of predetermined mass or size within a predetermined area adjacent the lantern.

Yet another object of the invention is to provide a lantern of the general character referred to above that includes a light reflector that can be selectively moved from a stored position to an in-use position where it concentrates light generated by the lantern to an area adjacent one side of the lantern.

It is an object and a feature of the invention to provide a lantern of the general character referred to above that includes an interrelated battery power supply, light-emitting fluorescent tubes, an audible signal-emitting horn or device, a motion-detecting device with normally open switch means; and, a manually operable multi-positioned switch operable to selectively connect the battery power supply with the tubes, connect the power supply with the motion detector and connect the motion detector with the tubes, connect the battery supply to the motion detector and connect the motion detector with the tubes and the alarm device; and, connect the battery power supply with the motion detector and connect the motion detector with the alarm device.

Another object and feature of the present invention is to provide a lantern of the general character referred to above including an elongate vertical housing with vertically spaced upper and lower housing sections between which a multiplicity of elongate vertical fluorescent tubes extend and within which electrical components are housed, an elongate central transparent section or globe positioned about the tubes and between the upper and lower housing sections; and, a light-reflecting panel within the housing and selectively shiftable between a stored position within the lower housing section and a working position within the globe at one side of the lantern and directing light generated by the tubes and impinging upon it towards the other side of the lantern.

Still another object and feature of the invention is to provide a lantern of the general character referred to above that includes a pair of laterally spaced vertical rods that are connected with and extend between the upper and lower housing sections and serve to tie the upper and lower housing sections and the globe in assembled condition, conduct electric power between electrical components housed within the upper and lower housing sections and support and guide the light movable light-reflecting panel.

Finally, it is an object and a feature of the present invention to provide a lantern of the general character referred to above wherein the bottom housing section defines a downwardly opening compartment in which batteries are removably stored and in which a base plate is removably engaged to close the lower open end of the compartment and to support the batteries therein; and, contact means within the compartment normally establishing contact with the batteries, tubes and rods and that is shiftable from engagement with the tubes and rods when the batteries are removed from the compartment to afford ready access to the tubes for easy replacement thereof and to the rods for easy disassembly of the lantern structure.

The foregoing and other objects and features of my invention will be apparent and will be fully understood from the following detailed description of one typical preferred form and embodiment of the invention throughout which description reference is made to the accompanying drawings.

DETAILED DESCRIPTION OF THE INVENTION

Figure 1:
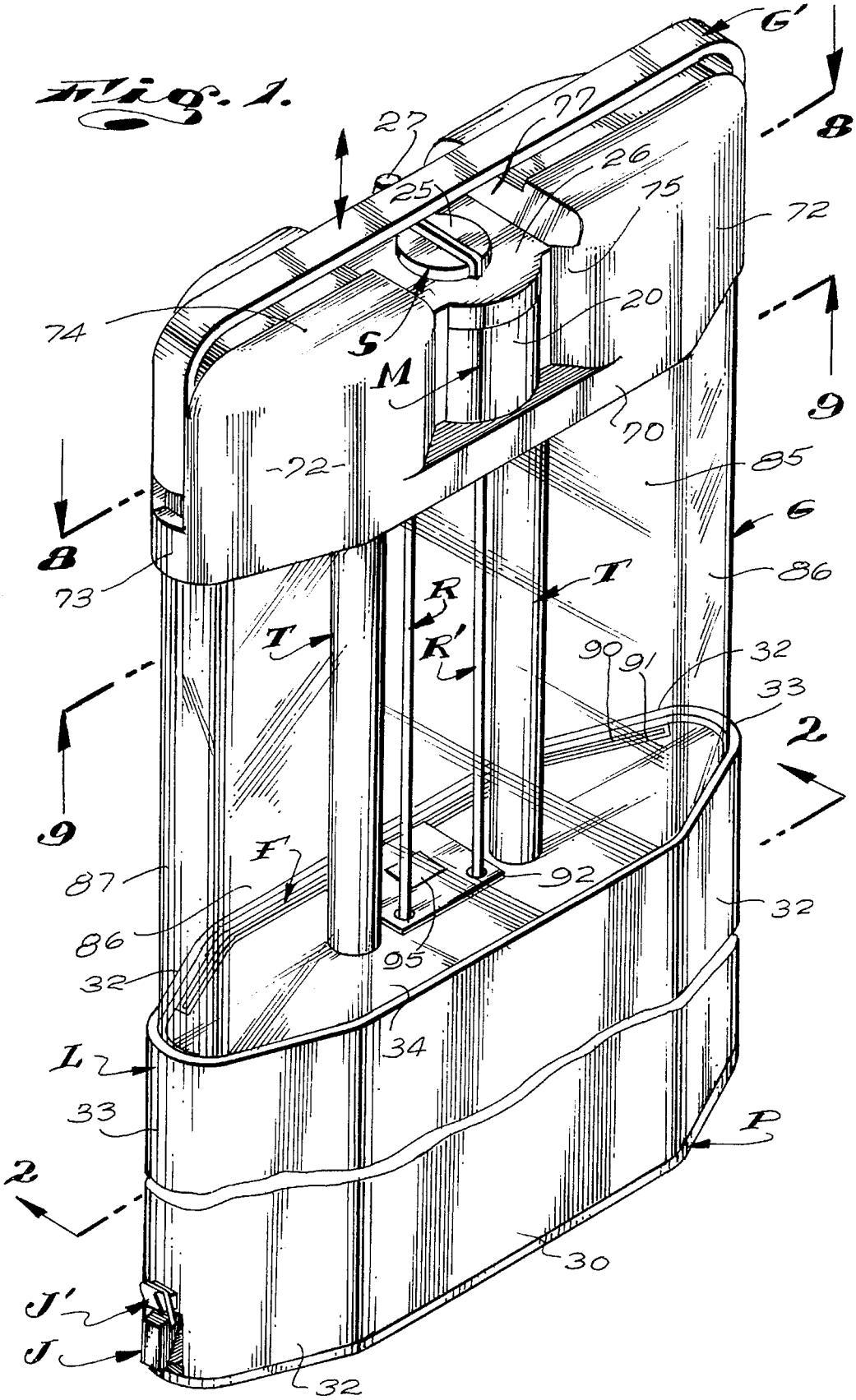
FIG. 1 is an isometric view showing the top, front and one side of my new Lantern.
Figure 2:
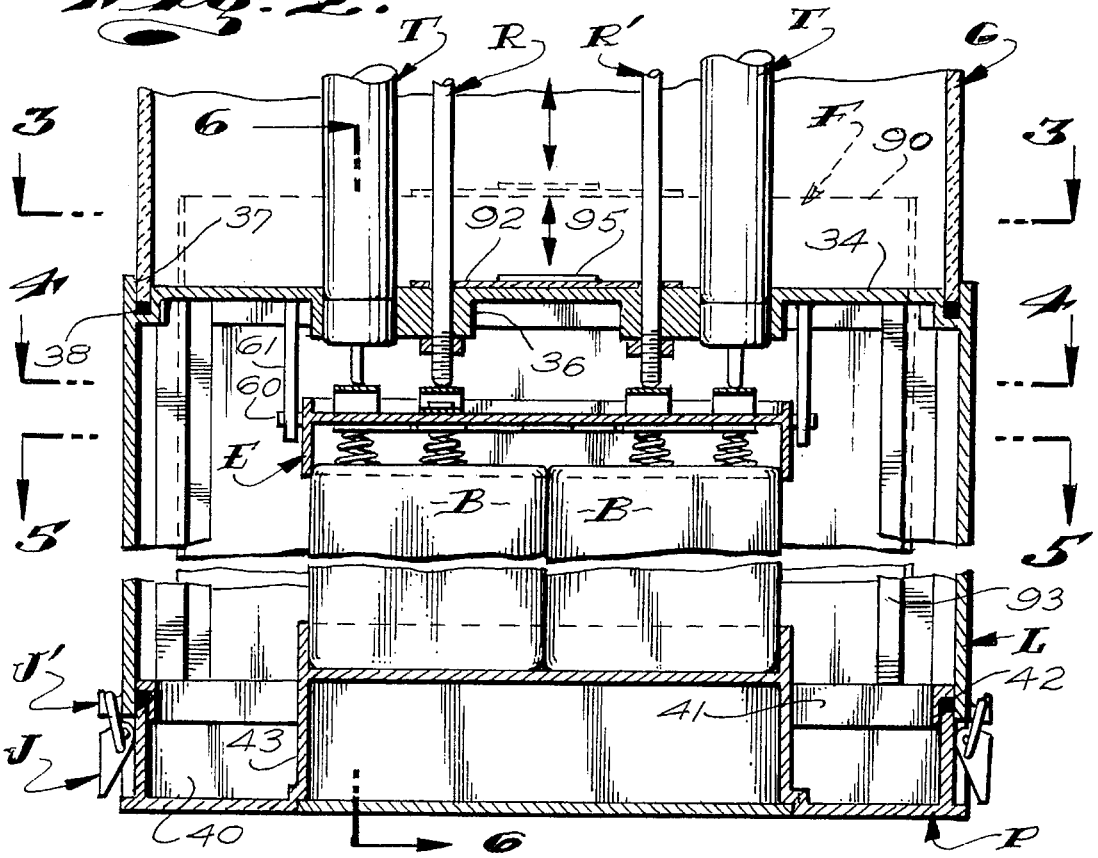
FIG. 2 is a sectional view taken substantially as indicated by Line 2—2 on FIG. 1.
Figure 6:
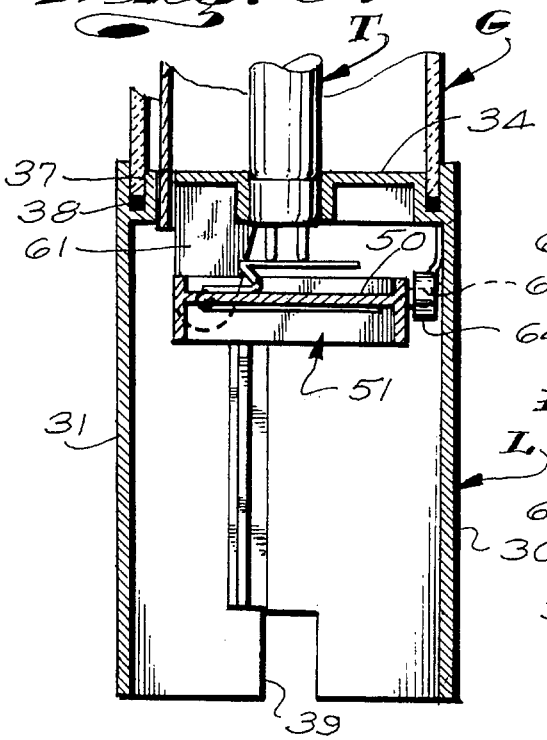
FIG. 6 is a sectional view taken substantially as indicated by Line 6—6 on FIG. 2.

Referring to the drawings, the lantern is shown as including a downwardly opening box-like lower housing section L that defines a battery storage compartment. The lower open end of the section L is normally closed by a horizontal base plate P that is suitable sealingly engaged within the lower end of the section L and is releasably retained in position by means of a pair of toggle latch devices J. The devices J can vary widely in details of construction and, in practice, can be replaced by other forms and/or kinds of latch means without departing from the broader aspects and spirit of our invention.

The lantern next includes an upper top housing section U that is in vertical spaced relationship above the lower section L. The section U can, as shown, be provided with a bail-like handle G to facilitate carrying the lantern. The handle G is preferably shiftable vertically between an up or in-use position and a down or stored position.

In addition to the foregoing, the upper section U houses an electronic motion-detecting device M that includes a vertically extending, semicircular, forwardly disposed lens 20 that is exposed at the central portion of a vertical front wall of the section U and such that the front surface of the lens is exposed to a horizontal field of view that extends through a quad rant of approximately 90° forward of the lantern.

The upper section U next carries a manually operable multi-position switch S that includes a manually engageable actuating knob 25 that occurs at and is accessible at a top wall or surface 26 within a central recess in the top of the section U.

Next, the upper section U houses and/or carries an audible signal-emitting device or horn H, parts of a latching means for a light reflector means F and including a manually engageable latch button 27; fluorescent tube ballasts or starters X; and, other necessary components and means.

The lantern next includes an elongate, vertically extending, transparent, intermediate or central tubular globe G that extends between the lower and upper housing sections L and U. The globe G has upper and lower open ends that oppose and that establish stopped sealed engagement within related upwardly and downwardly disposed channels in the sections L and U, as will here and after be described.

The lantern next includes a pair of laterally spaced, elongate, vertically extending fluorescent tubes T that extend vertically within the globe G and that have upper and lower end portions that extend into the upper and lower sections U and L. The tubes T are standard or conventional fluorescent tubes and have pairs of laterally spaced axially extending contact pins at their opposite ends.

A pair of elongate laterally spaced vertically extending rods R and R' are positioned between the tubes T and extend vertically through the globe G and between the sections U and L. The rods R and R' are multi-purpose rods that serve as tie rods that releasably secure the sections U and L and the globe G together; are electrical conductors that connect the electrical components in the upper and lower sections U and L together; and, are supports and guides for a reflector panel of a light reflector means F.

The lower housing section L is preferably molded of plastic and is polygonal in plan configuration. The section L is shown as having flat vertical front and rear wall 30 and 31 and laterally outwardly convergent pairs of sidewalls 32 that join to form vertically extending radius side edges 33. The section L next includes a horizontal top wall 34 with a pair of laterally-spaced tubular fluorescent tube-receiving collars or sleeves 35 depending therefrom.

The top wall 34 is further formed with a pair of laterally-spaced depending tubular rod receiving bosses or collars 36 through which the lower ends of the rods R and R' are engaged.

The lower housing section L is formed with an upwardly opening channel 37 about the perimeter of the top wall 34 and in which a ceiling ring 38 is positioned. The lower end of the globe G is slidably engaged in the channel 37 and is held in tight sealing engagement with the ring 38.

In the form of the invention illustrated, the section L has vertically extending laterally and downwardly opening notches 39 at the lower end of each of its side edges 33 to accommodate the latch devices J. Latch hooks J' are fixed to or are formed integrally with the housing section L to occur immediately above the notches 39.

The bottom plate P is a flat, horizontal unitary part that is the preferably molded of plastic. The plate P corresponds in planned configuration with the lower housing section L and has an upwardly projecting flange 40 about its outer perimeter portion that is normally slidably entered into the lower open end portion of the section L. The upper edge of the flange 40 terminates above the notches 39 and carries a part 41 that cooperates with the flange to define an outwardly opening sealing ring groove in which a sealing ring 42 is set to seal between the flange 40 of the plate and the housing section L.

In addition to the foregoing, the base plate P is formed with an upwardly projecting polygonal part 43 that defines an upwardly opening recess to receive, orient and retain the lower end portions of a pair of standard 6-volt dry cell batteries B. The batteries B are square in plan configuration and have central upwardly projecting positive terminals and upwardly projecting negative terminals at one corner portion of their upwardly disposed top ends, as clearly shown in the drawings.

The batteries B are carried by the plate P and project upwardly into the lower housing section L with their upper ends terminating in spaced relationship below the top wall 34 and the collars 35 and 36 that depend therefrom.

In practice and as shown, the part 34 can be of substantial vertical extent and has a battery-supporting wall that is spaced above the main body of the plate P to establish a storage compartment that is accessible at the bottom of the plate P and in which accessories, such as an extension cord to facilitate connecting the lantern with an exterior power supply means, can be stored.

Figure 12:
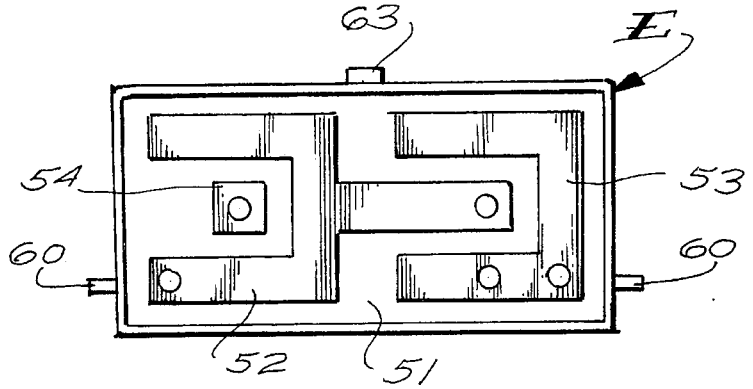
FIG. 12 is a bottom view of a circuit board part of my Lantern.
Figure 13:
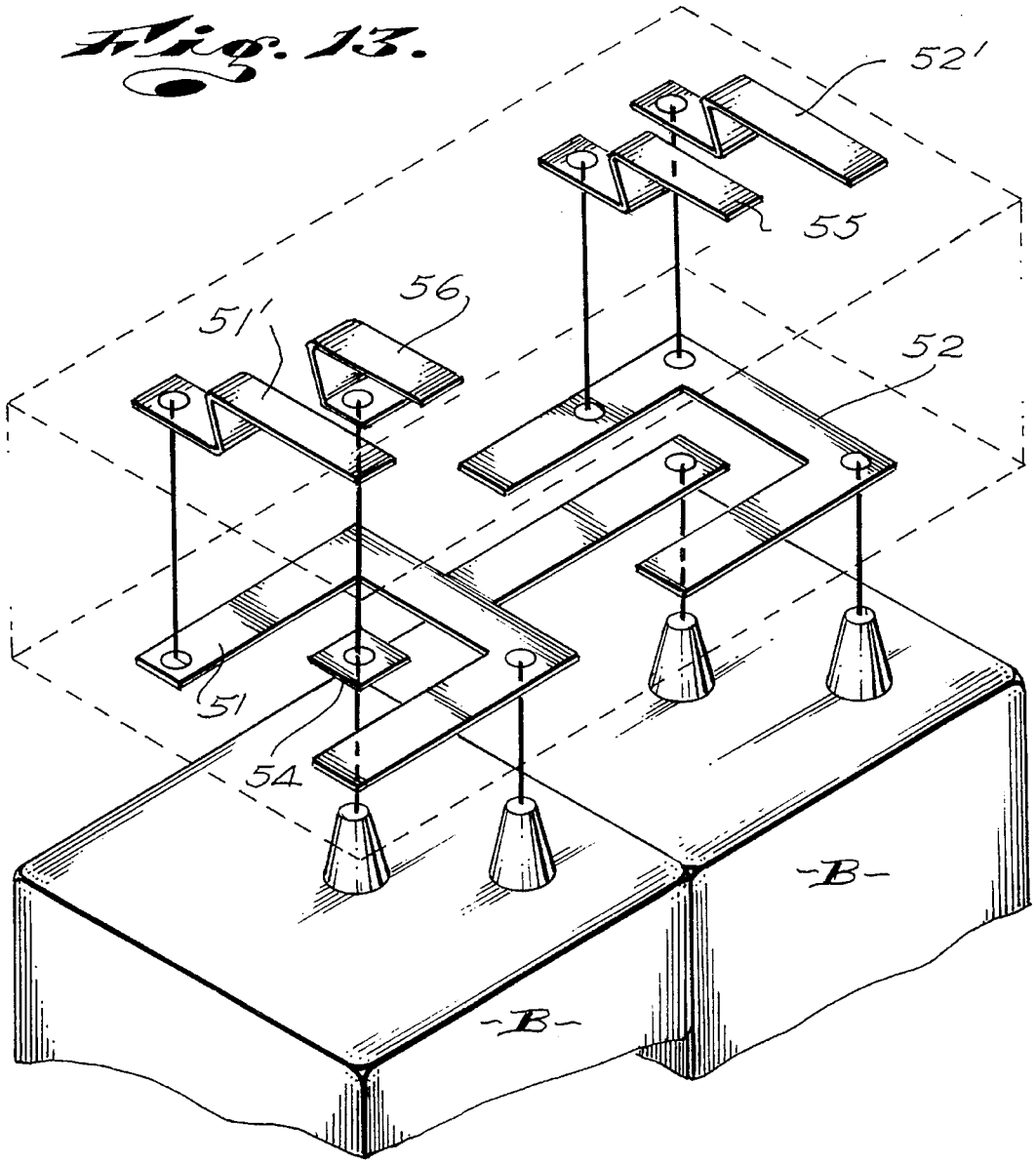
FIG. 13 is a diagrammatic view of the circuit board part.

Pivotally mounted within the lower housing section L to occur between the batteries B and the top wall 34 is a normally horizontally disposed contact plate E of molded plastic. The plate E has top and bottom surfaces 50 and 51. As shown in FIG. 12 of the drawings, the bottom surface 51 carries a pair of flat substantially U-shaped sheet metal contacts 52 and 53, each of which occurs about the outer perimeter portion of the top of a related battery B so the negative terminal of that battery is in contact therewith regardless of the rotative position of the battery about its central vertical axis. The U-shaped contact 52 related to one of the batteries B has a central laterally extending leg that occurs above and that is in contact with the central positive contact or terminal of the other battery B and serves to connect the two batteries in series. Finally, the bottom surface of the plate E has a sheet metal contact 54 that occurs above and is in contact with the central positive terminal of said one battery.

Figure 4:
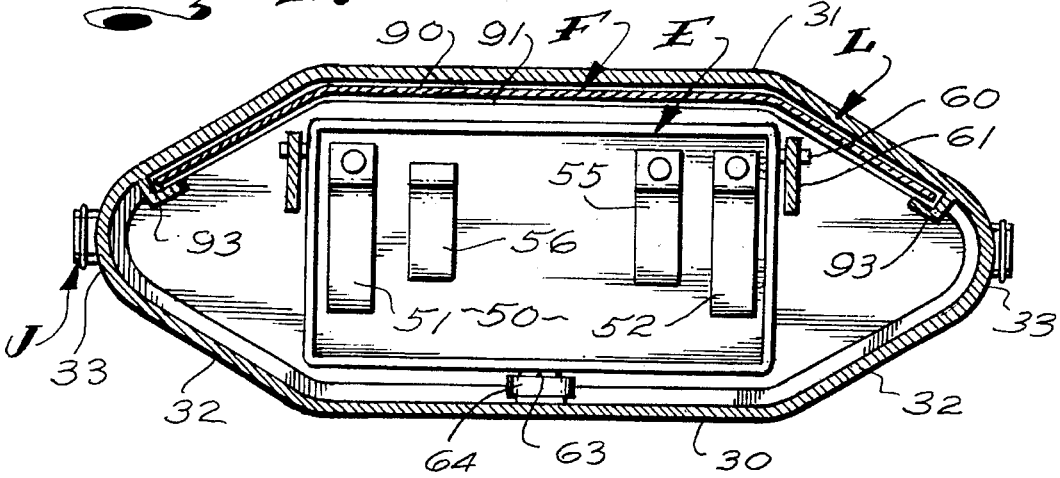
FIG. 4 is a sectional view taken substantially as indicated by Line 4—4 on FIG. 2.
Figure 5:
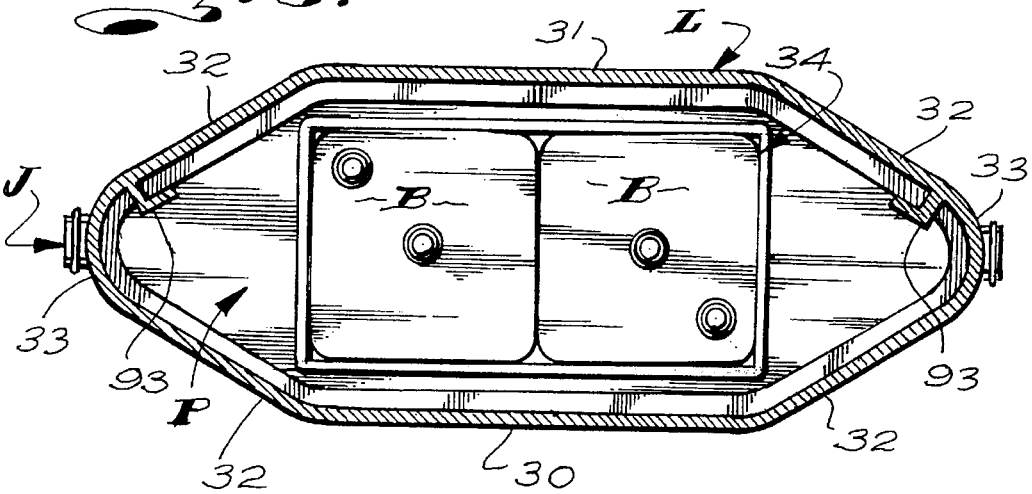
FIG. 5 is a sectional view taken substantially as indicated by Line 5—5 on FIG. 2.

The top surface of the plate, as shown in FIG. 4 of the drawings carries a pair of laterally-spaced spring-biased metal contacts 52' and 53' that are connected with the contacts 52 and 53 on the bottom surface of plate E. The contacts 52 and 53 occur below their related fluorescent tube-receiving collars 35 on the upper wall 34 of the section L and normally yieldingly engage the contact pins at the lower ends of their related tubes T that are engaged in and through the collars. The top wall has a spring contact 55 that is connected with the contact 52 and that occurs below collar 46 in and through which the rod R' is engaged to normally yieldingly contact the lower end of that rod. The plate E next carries a spring-biased metal contact 56 that is connected with the contact 54 and that occurs below the collar 46 through which the rod R is engaged and that normally yieldingly contacts that rod.

With the plate E illustrated and described above, it will be apparent that the two 6volt batteries B are connected in series and establish a 12-volt power supply. Further, it will be apparent that the rod R is connected with the positive side and the rod R' is connected with the negative side of the power supply.

While the contact plate E might be screw fastened in place within the housing section L, it is preferably pivotally supported in the section L so that it can be pivoted downwardly from its horizontal position beneath the top wall 34 of the housing section to a vertical position where is occurs adjacent to the rear wall of the section L and in lateral space relationship from below the lower ends of the tubes T so that the tubes T can be let to drop and/or can be manually withdrawn from within the lantern structure, through the open bottom of the housing section L.

To the above end, the plate E is an elongate rectilinear unit with front, rear, and end edges. The rear end portion of the end edges of the plate are provided with laterally outwardly projecting pins 60 that are engaged in openings in mounting brackets 61 that are formed on and depend from the top wall 34 of the section L, substantially as shown in the drawings. The front edge of the plate is formed with a forwardly projecting latch pin 63 that is normally releasably engaged in a substantially U-shaped spring latching clamp 64 that is mounted in the section L to engage in latch pin 63 when the plate 40 is in its normal horizontal position. It will be apparent that the particular latch means described in the foregoing is but one form of latch means that might be advantageously used in carrying out our invention.

In practice, it is preferred that the plate E be formed with a vertical frame-like flange about its perimeter that occurs about the upper end portion of the batteries B and serves to hold the batteries B in proper working position within the structure and relative to the plate E.

In practice, the design and construction of the plate E, the means provided to pivotally support the plate within a section L, can be varied without departing from the broader aspects and spirit of our invention.

It is to be noted that the spring-biased contacts 52' and 53' that engage the pins at the lower ends of the tubes T yieldingly support the tubes T in an up and working position within the working structure and serve as shock absorber means that protect the tube from shock damage that might be directed onto and through them in the normal handling and use of the lantern.

The upper housing section U of the lantern includes a unitary molded plastic part that is similar in plan configuration with the lower housing section L. The section U has substantially flat, vertical front and rear walls 70 and 71 and pairs of laterally outwardly convergent end walls 72 that converge at a vertical, radiused, end edges 73. The section U has an open bottom and has a top wall 74 that can be somewhat crowned and that is joined with its related vertical walls by well radiused corners.

The end edges 73 and top wall 74 are formed with a recess that accommodates the handle G when the handle is in its lower or retracted position.

The front wall 70 of the section U is formed with a forwardly opening recess 75 with a window in it through which the vertically extending semi-circular lens 20 of the above-noted motion detecting device M is positioned.

The top wall 74 of the section U is formed with a central, upwardly opening recess 77 that is defined in part by the aforementioned wall 26 with which the knob 25 of the switch S is related and is clearly shown in the drawing.

The lower open end of the upper section U is normally closed by a horizontal bottom plate 78. The outer perimeter of the plate 78 is formed with and upwardly and outwardly extending flange-like extension that cooperates with the section U to define a downwardly opening channel or groove 79 in which a sealing ring 79' is set. The upper end portion or edge of the globe G is slidably engaged into the groove 79, in sealing engagement with the seal 79'.

Figure 8:
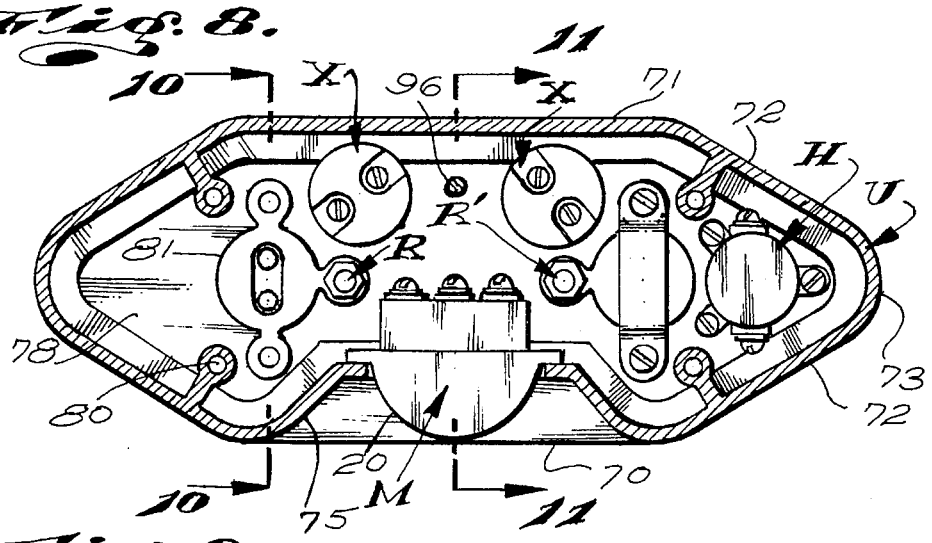
FIG. 8 is a sectional view taken substantially as indicated by Line 8—8 on FIG. 1.
Figure 9:
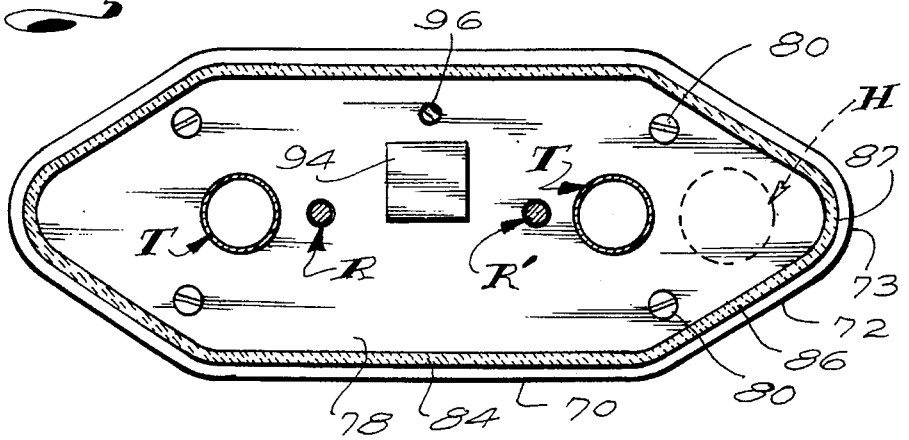
FIG. 9 is a sectional view taken substantially as indicated by Line 9—9 on FIG. 1.

The plate 78 is releasably secured through the upper housing section by suitable screw fasteners 80 as shown in FIGS. 8 and 9 of the drawings.

The plate 78 is formed with a pair of laterally spaced, upwardly projecting, downwardly opening tube-receiving sockets 81 in which the upper ends of the tube T are engaged; and, tubular collars 82, adjacent to the sockets 81 and in and through which the upper ends of the rods R and R' are engaged.

The upper and lower end portions of the rods R and R' are threaded and project upwardly and downwardly from within their related collars to define electrical terminal posts. Nuts 83 are engaged on the threaded end portions of the rods and engage their related collars are shown in the drawings.

The globe G is an elongate vertically extending part made of transparent plastic material. The globe G has vertically extending substantially flat front, rear and side walls 84, 85 and 86 and vertical edges 87 corresponding to related walls and edges of both the top and bottom housing sections. The lower and upper edges of the globe G are entered into the downwardly and upwardly opening channels 37 and 79 at the top and bottom of the sections L and U and into engagement with the sealing rings 38 and 79' in the channels. The nuts 83 at the ends of the rods R and R' are advanced on the rods to draw and to releasably hold the housing sections L and U and the globe G in tight clamped engagement with each other.

Figure 7:
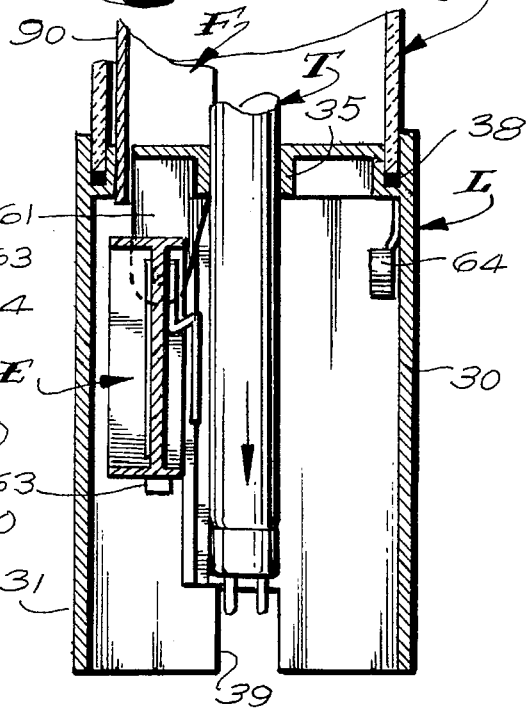
FIG. 7 is a view similar to FIG. 6 with part in another position.
Figure 3:
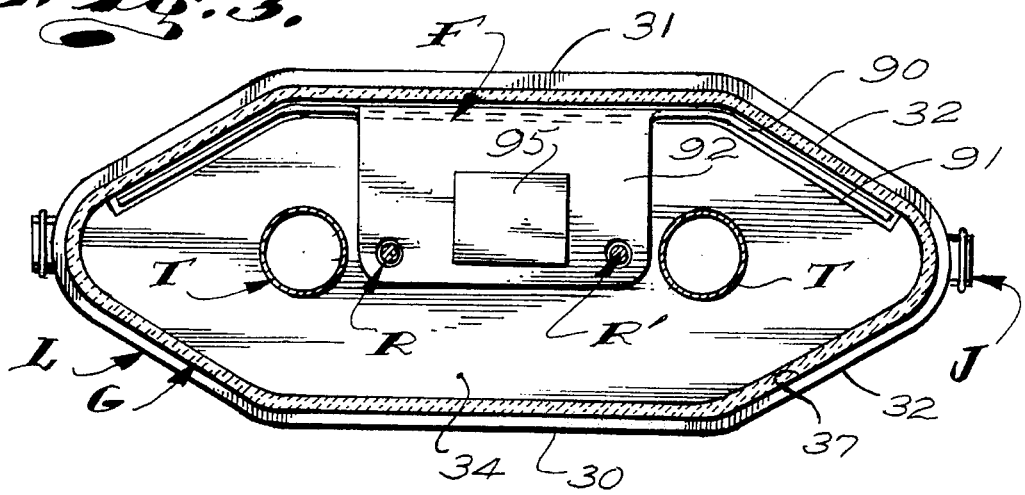
FIG. 3 is a sectional view taken substantially as indicated by Line 3—3 on FIG. 2.

It will be apparent that when the base plate P and the batteries B are removed from engagement in and with the lower housing section L; and, when the contact plate E is pivoted to its down position in the section L, as shown in FIG. 7 of the drawings, the nuts 82 at the lower ends of the rods R and R' are readily accessible and can be easily removed so that the lower section L and the globe G can be separated from the upper housing section U. When the structure is thus partially disassembled, the screw fasteners 80 securing the bottom plate 78 to the upper section U can be easily engaged and removed. With the screws 80 removed, the plate 78 can be disengaged from the section U affording access to the interior of the section U and to the elements and components that are within the section U and/or carried by plate 78.

When the lantern structure is fully assembled, it is watertight and is sufficiently buoyant that it will float should it be dropped or placed in water. The batteries which are the heaviest parts of the construction and that are housed within the lower housing section L act as a ballast and cause the lantern to float in an upright position where a portion of the globe G occurs above the surface of the water in which the lantern floats. Accordingly, if the lantern is on and should it be dropped into water at night, the light emitted from the lantern can be seen to enable a user of the lantern to locate and retrieve it.

With the lantern structure thus far described, light emitted from the tubes T flood an entire 360° field about the lantern. Due to the limited amount of light that is generated by the tubes, the extent to which the field about the lantern is lighted is limited and might be inadequate to enable the user of the lantern to read, do fine work and the like. It is not infrequent that the users of lanterns of the general class here concerned with frequently seek to concentrate the light emitted by the tubes to a small or limited area adjacent one side of their lanterns. This is most frequently accomplished by placing sheets of aluminum foil about portions of the lantern to serve as light reflectors. The disadvantages and inconveniences of such practices are so apparent that they need not be recited.

In furtherance of the present invention our new lantern is provided with a novel light reflector means F that is selectively operable to reflect and concentrate light emitted by the tubes T to one side of the lantern. The reflector means F is such that it operates to reflect and to concentrate light emitted from the tubes T through about a 90° quadrant of the normal 360° field about the lantern. The means F includes an elongate vertically extending aluminized plastic reflector panel 90. The panel 90 is shiftable vertically from a lower retracted position where it occurs within the lower housing section L to an upper operating position where it occurs within the globe G, adjacent the inside surfaces of the rear and end walls 85 and 86 of the globe G. The panel 90 is shiftably engaged in and through a slot 91 in the top wall 34 of the lower housing section L. The slot 91 allows the panel to be shifted vertically up and down, to occur in working position in the globe or in stored position within the housing section L, as desired or as circumstances require.

The upper end of the panel 90 has a horizontal flange 92 that projects forwardly between the tubes T and in and through which the rods R and R' are slidably engaged. The slot opening 91, flange 92 and rods R and R' guide and hold the panel 90 in proper working position when it is in its up position within the globe G.

The panel 90 is of such vertical extent that when it is in its up position, its lower end portion remains engaged in the slot 91.

Suitable guide means are provided within the lower housing section L to hold and maintain the panel 90 in proper position within the section L when it is in its lower position. In the case illustrated, the guide means within the lower housing section L includes vertically extending L-shaped guide parts 93 formed integrally with the end walls of the section L and that cooperate therewith to define vertical channels in which the vertical side edge portions of the panel 90 are slidably engaged and retained, when the panel is in its lower position.

The reflector means F next includes a suitable manually releasable latch means to releasably hold the panel L in its up or working position. In the case illustrated, the latch means includes a flat, horizontal ceramic magnet 94 fixed to the bottom surface of the bottom plate 78 to occur above the flange 92 on the panel 90. The latch means next includes a thin, flat, ferrous metal pad 95 fixed to the top surface of the flange 92 and such that when the panel is in its up position the pad 95 engages and is held by the magnet 94. The latch means next includes an elongate vertically shiftable release rod 96 that has a lower end portion that is engaged through an opening in the bottom plate 78 to engage the top of the flange 92 and an upper end portion that extends through an opening in the wall 26 of the upper housing section U and is suitably coupled with the aforementioned button 27, which is a vertically compressible, resilient release button that is carried by and projects upwardly from the wall 26 of the upper section U where it is conveniently, manually accessible. When the panel is in its up position and it is desired to release it and allow it to drop, by the force of gravity, to its lower position, the user manually depresses the button 27. The rod 96 pushes the flange 92 and the plate 95 downwardly and from engagement with the magnet 94. When thus released, the panel drops freely downwardly and into stored position within the lower housing section L.

When it is desired to move the panel upwardly from its down position to its up position, the lantern is manually turned upside down to cause the panel to drop to its up position, where upon, the lantern is turned upright and put to its normal and intended use.

The latch means illustrated and briefly described in the foregoing is but one of many forms of latch means that might be advantageously used in carrying out our invention without departing from the broader aspects and spirit thereof.

In the preferred carrying out of the invention, the panel 90 is made of thin flexible, transparent plastic sheet material and has a light-reflecting coating on its forwardly disposed surface. The reflective coating is such that a predetermined amount of light impinging upon the panel is reflected and the remainder of the light impinging upon it passes through it. For example, the reflective panel is made to reflect 80% of the light impinging upon it and allows 20% of the light to pass through it. Accordingly, when the reflector panel is up and in use, most of the light generated by the tubes is reflected forwardly and a lesser amount of light passes through it. Accordingly, while the reflector panel serves to reflect and concentrate light to the forward side of the lantern, the backside of the lantern is not "blacked-out" and such that the lantern cannot be seen from the backside thereof. Enough light passes through the panel to illuminate the backside of the lantern so that it is not subject to being accidentally kicked or stumbled over in the night dark and so that the lantern serves as a beacon for those who might approach it from its dark side.

The motion-detecting device M can be one of several different makes and/or models of commercially available motion-detecting devices suitable for use in carrying out our invention. Those devices are infrared-sensing devices that include normally open switching means that close when heat from an object within the field of view of the devices is sensed. Typically the field of view of such devices extends throughout a 90° horizontal arc. Different makes and models of commercially available motion-detecting devices that might be used in putting our invention into practice vary considerably in detail of construction and have different space requirements. Such devices typically include a forwardly disposed semi-circular eye or lens such as shown at 20 in the drawings and are such that they can be conveniently housed in the upper housing section U of the lantern.

Figure 14:
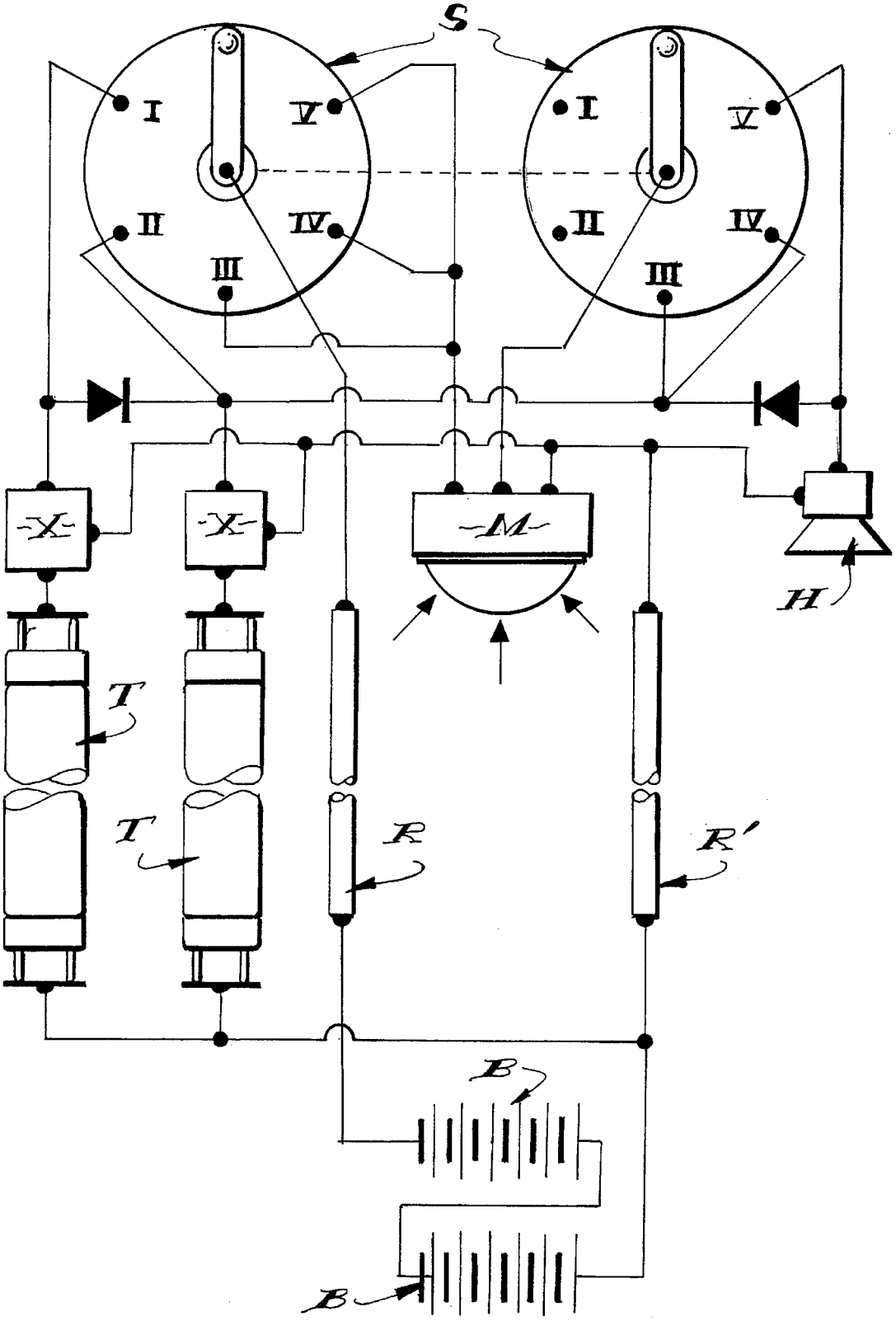
FIG. 14 is a circuit diagram.

The switch S, which is diagrammatically illustrated in FIG. 14 of the drawings is a compound rotary switch. The switch S is mounted within the upper housing section U beneath the central recessed top wall 26 thereof and has an upwardly projecting shaft that projects through the top wall and that carries the manually engageable rotary-operating knob 25.

The switch S can be selected from a number of different makes and models of commercially available switches or can be specially made for use in carrying out our invention as desired or as circumstances might require.

The signal-emitting device H used in carrying out our invention can be selected from a great number of commercially available signal-emitting horns. The precise positioning and mounting of the horn within the housing section U depends upon the size and details of construction of the device H that one might elect to use. In the case illustrated, the device H is mounted atop the lower plate 78 and within one end of the upper housing section U, as clearly shown in FIG. 8 of the drawings.

Depending upon that make and/or model of motion-detecting device M, switch S and horn H that are selected to be used in carrying out our invention, the position of those devices within the lantern structure and relative to each other must be appropriately adjusted and details of the construction of the housing section U and the plate 78 must be adjusted to accommodate them.

The electrical contact or terminal means at the upper ends of the rods R and R' can vary in details of construction. In the case illustrated, they are simple sheet metal terminals engaged about the rods to occur between the nuts 83 on the rods and the sleeves 82 through which the rods extend.

Figure 10:
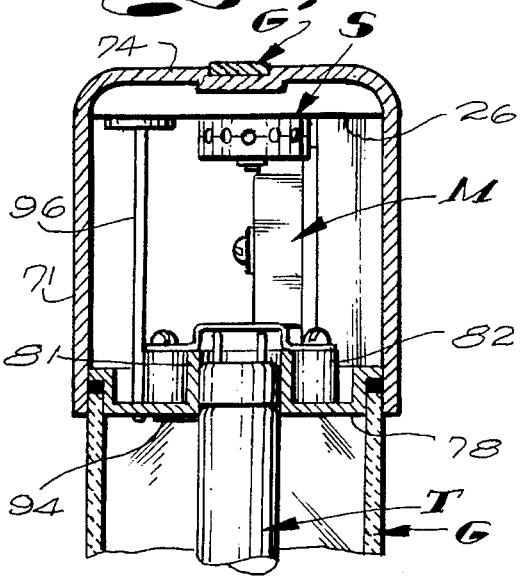
FIG. 10 is a sectional view taken substantially as indicated by Line 10—10 on FIG. 8.
Figure 11:
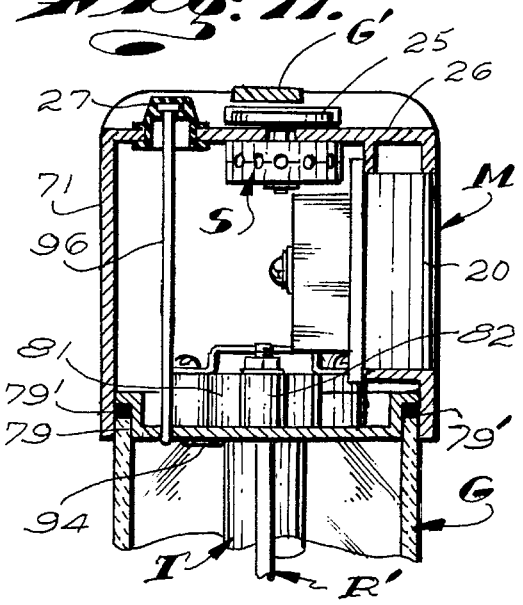
FIG. 11 is a sectional view taken substantially as indicated by Line 11—11 on FIG. 8.

The electrical contacts provided to contact the contact pins 100 at the upper ends of the tubes T are shown as elongate bridge-like parts that overlie the tops of the sockets 81 and that have mounting pads at their opposite ends that are suitably screw-fastened in place as clearly shown in FIGS. 8 and 10 of the drawings.

In addition to the foregoing, the electrical circuit and/or components of our lantern includes an electric ballast or starter X related to each tube T and connected between the contacts at the upper ends of the tubes and the switch S.

Referring to the circuit shown in FIG. 14 of the drawings, the switch S is shown in its normal open position, when the switch S is operated to close to its first closed position I, one tube T (the left-hand tube) is energized. When the switch S is operated to close at its second closed position II, both tubes are energized. When the switch is operated to close at its third closed position III, the motion-detecting device M is put into operation and is such that when the normally open switch means thereof closes in response to an intruder within the active field of the lantern, both tubes are energized. When the switch is operated to close at its fourth closed position IV, the motion-detecting device is put into operation and when the normally open switching means thereof is caused to close, both tubes T and the horn H are energized. When the switch means is closed to its fifth closed position V, the motion detector means is put into operation and such that when the normally open switch means thereof is closed, the alarm device H is energized.

In accordance with the above, it will be apparent that our new lantern is selectively operable to effect energizing one tube T for frugal use of available power; effect energizing both tubes; automatically energize both of the tubes in response to detected motion; automatically energize both tubes T and the device H in response to detected motion; and, automatically energize the device H in response to detected motion.

In practice, all of the above-noted functions need not be provided for. For example, the functions afforded by closed position I and V of the switch could be eliminated without departing from the broad aspects and spirit of my invention.

Having described one typical preferred form and embodiment of my invention, I do not wish to be limited to the specific details herein set forth but wish to reserve to myself any modifications and/or variations that might appear to those skilled in the art and that fall within the scope the following claims.

Having described my invention, I claim:

1. An elongate vertically extending lantern including upper and lower housing sections and a central elongate vertically extending tubular globe with spaced apart oppositely disposed transparent front and rear walls, spaced apart oppositely disposed transparent side walls and upper and lower ends sealingly engaging the upper and lower housing sections, a plurality of spaced apart vertically extending fluorescent tubes positioned within the globe and having upper and lower ends that are within the upper and lower housing sections, a battery power supply within the lower housing section, electric circuit means connecting the battery power supply with the lower ends of the tubes, a manually operable multi-position switch connected with the power supply by the electric circuit means and having a normal open position and a first closed position, electric conductors connecting the first closed position of the switch to the upper ends of the tubes, a flat vertically and laterally extending, forwardly disposed, reflector panel positioned within the rear portion of the lantern and selectively shiftable between a down stored position within the lower housing section to an up operating position within the globe, rearward of the tubes and forward of the rear wall and of the globe.

2. The lantern se forth in claim 1 that further includes an electric powered motion detector carried by the upper housing section and disposed forwardly to detect motion of objects forward of the lantern and towards which lightly emitted by the tubes and light reflected by the light reflector panch is directed, the motion detector includes a normally open switching device that is closed when motion is detected and that is connected between a second closed position of the switch and the upper ends of the tubes.

3. The lantern wet forth in claim 2 wherein the switch has a third closed position that is connected with the position detector and that further includes an electric powered audible alarm-emitting device that is connected with the electric circuit means and with the motion detector so that the light-emitting tubes and the audible alarm-emitting device are energized to emit light and an audible alarm when motion is detected by the motion detector.

4. The lantern set forth in claim 1 wherein the lower ends of the tubes are slideably engaged through vertical through openings in a top wall of the lower housing section, the battery power supply includes elongate vertically extending batteries with upper and lower ends and upwardly projecting terminal posts, the batteries are supported atop a removable bottom plate at a lower end of the lower housing section, said electric circuit means includes a circuit board pivotally mounted in the lower housing section to and that is normally positioned below the lower ends of the tubes and above the batteries and connects the lower ends of the tubes and parts of said circuit means with related terminal posts on the batteries, the circuit board is pivotally movable from beneath and clear from the tubes when the base plate and the batteries are removed from the lower housing section afford free access to the tubes.

5. The lantern set forth in claim 4 wherein the electric circuit means includes a first tie rod extending vertically through the globe and having a lower end portion releasably connected with the lower housing section and normally contacting the circuit board plate and having an upper end portion connected with the upper housing section and electrically connected with the switch; and, an elongate second tie rod extending vertically through the globe and having a lower end portion releasably connected with the upper end connected with the motion detector and the audible sound-emitting device.

6. The lantern set forth in claim 1 wherein the electric circuit means includes a first tie rod extending vertically through the glove and having an upper end portion connected to the upper housing section and a lower end portion releasably connected to the lower housing section, an elongate second tie rod extending vertically through the globe in parallel relationship with the first tie rod and having an upper end portion connected to the lower housing section, an electric conductor connects the switch with the first tie rod, a circuit board in the lower housing section connects the lower ends of the tubes and the lower ends of the first and second tie rods with related terminals of the battery power supply, the upper end of the light reflector panel has a forwardly projecting part that is slideably engaged with the tie rods for free vertical guided movement of the light reflector panel relative thereto, the light reflector panel is moveable vertically through and is freely guided by a slot opening in a top wall of the lower housing section.

7. The lantern set forth in claim 1 that further includes a manually releasable latch means including a first part carried by the upper end of the light reflector panel, a second part carried by the upper housing section and releasably engaging the first part when the light reflector panel is in said up operating position, and a manually engageable release part carried by the upper portion and engaging the first part to disengage it from the second part.

8. The lantern set forth in claim 7 that further includes an electric powered motion detector carried by the upper housing section and disposed forwardly to detect motion of objects forward of the lantern and towards which light emitted by tubes and light reflected by the light reflector panel is directed, the motion detector includes a normally open switching device that is closed position of the switch and the upper ends of the tubes.

9. The lantern set forth in claim 8 wherein the switch has a third closed position that is connected with the motion detector and that further includes an electric powered audible alarm-emitting device that is connected with the third open position of the switch and with the motion detector so that the light-emitting tubes and the audible alarm-emitting device are energized to emit light and an audible alarm when motion is detected by the motion detector.

10. An elongate vertically extending lantern including upper and lower housing sections and an elongate vertically extending central tubular glove with spaced apart oppositely disposed transparent front and rear walls, spaced apart oppositely disposed transparent side walls and upper and lower ends sealingly engaged with the upper and lower housing sections, a plurality of spaced apart vertically extending fluorescent tubes positioned within the globe and having upper and lower end portions that are within the upper and lower housing sections, a battery power supply within the lower housing section, electric circuit means connecting the battery power supply with the lower ends of the tubes, a manually operable multi-position switch carried by the upper housing section and connected with the power supply by the electric circuit means and having a normal open position and a first closed position, an electric conductor means connecting the closed position of the switch to the upper ends of the tubes; an electric powered motion detector carried by the upper housing section and disposed forwardly to detect motion of objects forward of the lantern, the motion detector includes a normally open switching device that is closed when motion is detected and that is connected between a second closed position of the switch and the upper ends of the tubes; the lower ends of the tubes are vertically slidably engaged through openings in a top wall of the lower housing section, the battery power supply includes elongate vertically extending batteries with upper and lower ends and upwardly projecting terminal posts, the batteries are supported within the lower housing mop a removable and manually closing the bottom plate at the lower end of the lower housing section, said electric circuit means includes a normally circuit board pivotally mounted in the lower housing section and positioned below the lower ends of the tubes and above the batteries to connect the lower ends of the tubes and parts of said circuit means with related terminal posts on the batteries, the circuit board is pivotally movable from beneath the tubes to a vertical position spaced from the tubes when the base plate and the batteries are removed from the housing section to afford free access to the tubes.

11. The lantern set forth in claim 10 wherein the electric circuit means includes a first tie rod extending vertically through the globe and having a lower end portion releasable connected with the lower hanging section and contacting the circuit board plate and an upper end portion connected with the upper housing section and electrically connected with the switch; and, an elongate second tie rod extending vertically through the globe and having a lower end portion releasable connected with the lower housing section and normally contacting the circuit board and an upper end portion connect with the upper housing section and electrically connected with the motion detector and the audible sound-emitting device.

* * * * *